US007582126B2

(12) United States Patent
Martyak et al.

(10) Patent No.: US 7,582,126 B2
(45) Date of Patent: Sep. 1, 2009

(54) FATTY ESTER COMPOSITIONS WITH IMPROVED OXIDATIVE STABILITY

(75) Inventors: Nicholas Martyak, Doylestown, PA (US); Michael Gernon, Phoenixville, PA (US); Conor Dowling, Ambler, PA (US); Daniel Alford, Pottstown, PA (US)

(73) Assignee: Arkema France, Colombes (FR)

( * ) Notice: Subject to any disclaimer, the term of this patent is extended or adjusted under 35 U.S.C. 154(b) by 857 days.

(21) Appl. No.: 11/312,108

(22) Filed: Dec. 20, 2005

(65) Prior Publication Data

US 2007/0137098 A1 Jun. 21, 2007

(51) Int. Cl.
*C10L 1/18* (2006.01)
*C10L 1/22* (2006.01)

(52) U.S. Cl. ..... 44/388; 44/420; 44/422; 44/450

(58) Field of Classification Search ..... 44/388, 44/420, 422, 450
See application file for complete search history.

(56) References Cited

U.S. PATENT DOCUMENTS

| | | | | |
|---|---|---|---|---|
| 3,492,233 | A * | 1/1970 | Hepplewhite et al. | 508/454 |
| 4,268,655 | A | 5/1981 | Homan et al. | |
| 5,176,850 | A | 1/1993 | O'Neil | |
| 2003/0167679 | A1 | 9/2003 | Jordan | |
| 2005/0156143 | A1 | 7/2005 | Shimura et al. | |

* cited by examiner

*Primary Examiner*—Cephia D Toomer
(74) *Attorney, Agent, or Firm*—Steven D. Boyd

(57) ABSTRACT

Compositions containing unsaturated fatty esters may be stabilized against atmospheric oxidation by the addition of an antioxidant package containing a phenolic oxidant and a non-phenolic oxygen scavenger, which may be a hydroxylamine, an amine N-oxide, an oxime, or a nitrone. If an amine N-oxide is used, it may be used with or without a phenolic antioxidant. Compositions treated in this manner show good resistance to atmospheric oxidation and resultant viscosity increase.

22 Claims, No Drawings

FATTY ESTER COMPOSITIONS WITH IMPROVED OXIDATIVE STABILITY

FIELD OF THE INVENTION

The invention relates to fatty esters. More particularly, it relates to fatty esters containing additives that reduce their oxidative degradation.

BACKGROUND OF THE INVENTION

Fatty esters are widely used commercially in a variety of applications. Commonly used esters include natural fats and oils, especially triglyceride oils. Well known examples include soybean oil, canola oil, olive oil, linseed oil, and tung oil.

Another important type of fatty ester is biodiesel, a clean-burning alternative fuel produced from domestic, renewable resources. Biodiesel contains no petroleum, but it can be blended at any level with petroleum diesel to create a fuel blend. It can be used in compression-ignition (diesel) engines with little or no modification. Biodiesel is biodegradable, essentially nontoxic, and essentially free of sulfur and aromatic compounds, and thus can provide certain environmental advantages.

Biodiesel is essentially a mixture of methyl, ethyl, and/or isopropyl esters of fatty acids, made through transesterification of fatty acid triglycerides (oils) with the respective alcohols. The most commonly used raw material oils are seed oils such as soybean oil, palm oil, and rapeseed oil.

These and many naturally occurring fats and oils contain a component, sometimes a major one, of unsaturated fatty acids (mainly in the form of esters). These include such acids as oleic, linoleic, linolenic, and others bearing one or more olefinic moieties. Accordingly, biodiesel fuels made from these oils also typically contain unsaturated acids and/or esters thereof. In both natural oils and biodiesel, the unsaturation makes the materials susceptible to oxidation by atmospheric oxygen. Such oxidation, for example during processing or storage, may result in an increase in viscosity and/or pour point temperature, which in many cases is undesirable. Therefore, ways of reducing or eliminating oxidative degradation of fatty esters are sought in the various industries in which these materials are used.

SUMMARY OF THE INVENTION

In one aspect, the invention provides a composition including:

a) a fatty ester component constituting at least 50 wt % of the composition and including an unsaturated fatty ester; and b) an antioxidant package including a phenolic antioxidant or precursor thereof and a nonphenolic oxygen scavenger or precursor thereof;

wherein the nonphenolic oxygen scavenger or precursor thereof includes a hydroxylamine, an amine N-oxide, an oxime, a nitrone, or a mixture of any of these.

In another aspect, the invention provides a composition including:

a) a fatty ester component constituting at least 50 wt % of the composition and including an unsaturated fatty ester; and b) an amine N-oxide.

In a further aspect, the invention provides a method of making a stabilized composition, including blending together:

a) a fatty ester component including an unsaturated fatty ester; and b) an antioxidant package including a phenolic antioxidant or precursor thereof and a nonphenolic oxygen scavenger or precursor thereof;

wherein the nonphenolic oxygen scavenger or precursor thereof includes a hydroxylamine, an amine N-oxide, an oxime, a nitrone, or a mixture of any of these.

DETAILED DESCRIPTION OF THE INVENTION

According to the invention, compositions comprising fatty esters may be treated by the addition of an antioxidant package that slows or prevents increases in viscosity of the composition and/or increases in the pour point temperature. The composition includes at least the following:

a) a fatty ester component constituting at least 50 wt % of the composition and comprising an unsaturated fatty ester; and b) an antioxidant package comprising a phenolic antioxidant or precursor thereof and a nonphenolic oxygen scavenger or precursor thereof;

wherein the nonphenolic oxygen scavenger or precursor thereof comprises a hydroxylamine, an amine N-oxide, an oxime, a nitrone, or a mixture of any of these. In other embodiments of the invention, no nonphenolic oxygen scavenger is used, and an amine N-oxide is included (with or without the presence of a phenolic antioxidant) as a precursor that forms a nonphenolic oxygen scavenger (a hydroxylamine) under conditions of use.

Compositions to be treated with the antioxidant package include those containing at least 50 wt % of a fatty ester component comprising unsaturated fatty esters. Typically the fatty ester component will constitute at least 80 wt % of the composition, more typically at least 90 wt % and most typically at least 95 wt %. The fatty ester may be natural or synthetic. Nonlimiting examples of natural esters include soybean oil, canola oil, corn oil, olive oil, linseed oil, palm oil, rapeseed oil, safflower oil, sunflower oil, and tung oil. In certain embodiments, the ester may be a biodiesel, by which is meant a natural oil that has been transesterified with a lower alcohol, typically methanol, ethanol, and/or isopropanol. Biodiesel derived from any natural or synthetic fat or oil is suitable for treatment according to the invention. The composition may also contain a petroleum distillate, or it may be essentially free of distillates.

Petroleum distillates suitable for admixture with biodiesel fuels for use according to the invention include any of a variety of petroleum-based fuels, including but not limited to those normally referred to as "diesel." Exemplary distillates may also include gasoline, gas-oil, and bunker fuel. Petroleum middle distillates will be used in many applications, and such middle distillates include mineral oils boiling in a range from 120 to 450° C. obtained by distillation of crude oil, for example standard kerosene, low-sulfur kerosene, jet fuel, diesel and heating oil such as No. 2 fuel oil. Exemplary distillates that may be blended with biodiesel for treatment with an antioxidant package of this invention are those which contain not more than 500 ppm, in particular less than 200 ppm, of sulfur and in specific cases less than 50 ppm of sulfur or even less than 5 ppm. Useful distillates, especially middle distillates, are generally those which were subjected to refinement under hydrogenating conditions and which therefore contain only small amounts of polyaromatic and polar compounds that impart natural lubricating activity to them. Distillates that have 95% distillation points of less than 370° C., in particular less than 350° C., and in special cases less than 330° C., may also be used.

The composition may, aside from the antioxidant package, consist essentially of the biodiesel (and optionally the petroleum distillates), or it may also contain other optional additives such as those detailed below. It should be noted that certain additives, when included in the compositions of this invention, may have a substantial effect on important properties of the treated composition. The effects of such changes may or may not be desirable in a given situation, and therefore some embodiments of the invention preclude the use of certain additives in an amount that materially affects one or more of these properties. Examples of such additives whose presence (in high enough amounts) may be precluded include compounds known to accelerate atmospheric oxidation of unsaturated fatty acids and their esters, including for example cobalt and manganese driers such as are used for curing alkyds and drying oils. Generally, oxidizing agents should be avoided. Such materials might include hydrogen peroxide or organic peroxides.

As distinct from the foregoing list of additives, certain other additives may typically be included in the treated composition in an amount sufficient to achieve certain performance advantages. In the case where the composition comprises a biodiesel, conventional diesel additives may be included. For example, surfactants may be included to help reduce the buildup of deposits. Other ingredients might also include octane boosters, cetane enhancers, pour point depressants, and explosion suppressors (e.g., tetraethyllead), and fatty acids for use as friction modifiers. Water may also be present in the treated fuel. If present, water may in some embodiments be included in only small amounts, i.e., at less than 2 wt % or even less than 0.5 wt %, most typically less than 500 ppm, as measured by ASTM 6751. It may however be present in larger amounts, for example from 2 to 25 wt % based on the total weight of the resulting mixture, more commonly 10 to 15 wt %, in the form of a solution, stabilized emulsion, or other dispersion.

Nonphenolic Oxygen Scavenger

The nonphenolic oxygen scavenger may be a hydroxylamine. Nonlimiting examples of suitable hydroxylamines are according to the formula $R^1R^2N—OH$, where $R^1$ and $R^2$ are each independently hydrogen, a linear or branched, saturated or unsaturated C1-C20 aliphatic moiety, which can optionally be mono- or polysubstituted, or a C6-C12 aryl moiety, a C7-C14 araliphatic moiety or a C5-C7 cycloaliphatic moiety. Representative hydroxylamines include but are not limited to: hydroxylamine, methylhydroxylamine, dimethylhydroxylamine, methylethylhydroxylamine, ethylhydroxylamine, diethylhydroxylamine, dibutylhydroxylamine, dibenzylhydroxylamine, monoisopropylhydroxylamine and mixtures thereof.

Another class of suitable nonphenolic oxygen scavengers comprises oximes derived from aldehydes or ketones. Examples include 2-butanone oxime, acetone oxime, cyclohexanone oxime, benzoin oxime, propanal oxime, butanal oxime, and isobutanal oxime.

Nitrones are also suitable for use as nonphenolic oxygen scavengers for use according to the invention. Any nitrone may be used. Suitable classes of nitrones may be described according to the formula

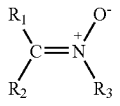

in which $R_1$ and $R_2$ may be the same or different and are each selected from the group consisting of hydrogen and hydrocarbon radicals having between one and ten carbon atoms. $R_3$ is a hydrocarbon radical having between one and ten carbon atoms. $R_1$, $R_2$, and $R_3$ may all be selected from alkyl groups (saturated or unsaturated), cycloalkyl groups, aryl groups, or aralkyl groups. Examples of suitable alkyl groups include methyl, ethyl, n-propyl, isopropyl, n-butyl, n-pentyl, n-hexyl, n-heptyl, n-octyl, n-nonyl, n-decyl, and the various n-hexenyl, n-heptenyl, n-octenyl, n-nonenyl and n-decenyl radicals. Examples of cycloalkyl, aryl, and aralkyl groups, respectively, include cyclohexyl, phenyl, and tolyl radicals. Typically the hydrocarbon radicals are groups having from one to seven carbons. Specific examples of suitable nitrones include formaldehyde isopropylnitrone; formaldehyde ethylnitrone, formaldehyde methyinitrone, acetaldehyde isopropylnitrone, acetaldehyde propyinitrone, acetaidehyde ethyinitrone, acetaldehyde methylnitrone, acetone isopropylnitrone, acetone propylnitrone, acetone ethylnitrone, acetone methylnitrone, acetone n-butylnitrone, acetone benzylnitrone, formaldehyde n-hexylnitrone, methyl ethyl ketone ethyinitrone, formaldehyde cyclohexylnitrone, isobutyraldehyde isopropylnitrone, isobutyraldehyde ethyinitrone, n-butyraldehyde isoproylnitrone, n-butyraldehyde ethyinitrone, and n-butyraldehyde propylnitrone.

In some embodiments, the oxygen scavenger comprises a compound having a vapor pressure greater than 10 Torr at 25° C., preferably greater than 20 Torr, and more preferably greater than 30 Torr. Diethylhydroxylamine is an example of such a compound, having a vapor pressure of 32 Torr. Without wishing to be bound by any particular theory or explanation, the inventors believe that the use of a sufficiently volatile scavenger may improve the efficacy of the antioxidant package by capturing oxygen in the headspace above the composition, thereby preventing at least some of the oxygen from reacting with unsaturated fatty esters. The nonphenolic oxygen scavenger (and/or precursor thereof) may be incorporated in the treated composition in any amount. Typically, it will be present in an amount equal to from 0.001 to 5 wt % relative to the fatty ester component, more typically from 0.01 to 2 wt %, and most typically from 0.01 to 1 wt %.

Precursors to Non-Phenolic Oxygen Scavengers

Precursors to certain non-phenolic oxygen scavengers, for example precursors to hydroxylamines, may be used in place of or in addition to the non-phenolic oxygen scavengers themselves. As used herein, the term "precursor" means a compound that liberates, or is converted to, the desired compound in the composition in an amount sufficient to provide resistance to oxidative degradation. In the case of hydroxylamine, one type of precursor is a salt thereof with an organic or inorganic acid. Such acids may include as nonlimiting examples hydrochloric acid, sulfuric acid, sulfonic acids, phosphonic acids, and carboxylic acids.

Another type of precursor for hydroxylamines is amine N-oxides. For example, triethylamine N-oxide decomposes slowly under typical ambient conditions to form ethylene and diethylhydroxylamine. Moreover, in addition to the use of amine N-oxides in combination with phenolic antioxidants, the inventors have found that their use alone can significantly slow atmospheric oxidation of compositions containing unsaturated fatty esters. Any N-oxide is suitable for use. In some applications, it is preferable that the N-oxide not act as a surfactant, for example in cases where another surfactant package is used or when no surfactant at all is desired. Some examples of amine N-oxide types that show little surfactancy include those of the formula $R^3R^4R^5N \rightarrow O$, in which $R^3$, $R^4$, and $R^5$ are each individually selected from C1-C8 linear or branched alkyl groups, provided that at least one of $R^3$, $R^4$, and $R^5$ has a primary, secondary, or tertiary carbon atom at the 2-position relative to N, so that the group may split out to form an olefin and thereby produce a hydroxylamine.

Phenolic Antioxidant or Precursor

Suitable phenolic antioxidants may be selected from a wide variety of materials known in the art. For example they may be substituted or unsubstituted hydroquinones. Nonlimiting examples include hydroquinones substituted in the ortho or meta positions (or both) with moieties including but not limited to C-1 to C-6 alkyl or aryl moieties. Two suitable examples are methylhydroquinone and tert-butylhydroquinone. In general, suitable phenolic antioxidants include any known dihydroxybenzene or aminohydroxybenzene compound or a lower alkyl, e.g., 1 to 8 carbon atoms, substituted derivative thereof. Specific suitable compounds include 2,4-diaminophenol; 5-methyl-o-aminophenol; o-aminophenol; p-aminophenol; 3-methyl-p-aminophenol; 4,6-diamino-2-methylphenol; p-methylaminophenol; m-aminophenol; p-(N-methylamino)phenol; o-(N-butylamino)phenol; 3,4-dihydroxybenzaldehyde; and 2,5-dihydroxybenzaldehyde. Others examples include catechols and substituted catechols, especially tertiary alkyl substituted ones. Some specific examples are p-(tert-butyl)catechol, p-(1,1-dimethylethyl) catechol, p-(1-ethyl-1-methyl hexyl)catechol, p-(1,1-diethylpropyl)catechol, p-tributylmethylcatechol, p-trihexylmethylcatechol, and p- (1,1-diethylethyl)catechol, etc. Precursors of phenolic antioxidants include benzoquinone and naphthoquinone, which may be converted to the corresponding phenolic compounds by contact with a reducing agent such as the nonphenolic oxygen scavenger. The phenolic antioxidant (and/or precursor thereof) may be incorporated in the treated composition in any amount. The effective amount of phenolic antioxidant may in some cases be as low as 0.01 ppm by weight, relative to the fatty ester component. Typically, it will be present in an amount equal to from 1 to 500 ppm, more typically from 2 to 200 ppm, and most typically from 4 to 100 ppm.

A fatty ester to be treated with the antioxidant package may simply be mixed with the components of the antioxidant package, either separately or in any combination, without any special processing steps beyond simple mixing and agitation. No heating or other special conditions are required, and in fact it is desirable in some embodiments to avoid higher temperatures so as to prevent reaction or decomposition of the components of the composition. Thus the components may be blended at ambient temperatures, although lower or higher temperatures may be used as long as mixing is reasonably facile and undesired reactions do not occur. Typically, the mixing temperature will be in a range from 10° C. to 50° C.

Treated compositions according to the invention generally provide low rates of oxidative degradation, making them suitable for use in a number of applications. They may for example be particularly suitable as biodiesel fuels for use in cold climates, where the negative effects of oxidative degradation are may be particularly troublesome due to the resulting increase in pour point temperature.

EXAMPLES

Example 1

Antioxidant Packages

Twelve samples of methyl oleate (70%, purchased from Aldrich Chemical Company) were prepared for oxidative stability evaluation. Run 1 was a control, Runs 2-6 used prior art antioxidant packages, and Runs 7-12 used antioxidant packages according to the invention. The following ingredients were used, in the amounts indicated in Table 1:

DEHA—diethylhydroxylamine

HQ—hydroquinone

TBC—tert-butylcatechol

TEAO—triethylamine N-oxide

Viscosity of each sample was measured on Day 0, using a Brookfield DV-II viscometer at 21.5° C. (+/−1° C.), and the bottles were then sealed. The bottles were opened every three days for approximately five minutes to admit oxygen, and then re-sealed. Samples were withdrawn from the bottles every seven days for viscosity measurement. The data in Table 1 show the changes in viscosity (in cP) over a 28-day period, where positive numbers indicate an increase in viscosity reflecting an increase in oleate polymerization due to oxidation of the sample.

TABLE 1

| Run # | DEHA (%) | HQ (mg/L) | TBC (mg/L) | TEAO (%) | Day 0 | Day 7 | Day 14 | Day 21 | Day 28 |
|---|---|---|---|---|---|---|---|---|---|
| 1 | — | — | — | — | — | 0 | 0.20 | 0.20 | 0.15 |
| 2 | 1 | | | | — | 0 | 0.30 | 0.25 | 0.20 |
| 3 | 4 | | | | — | 0 | 0.05 | 0.10 | 0.10 |
| 4 | | 5 | | | — | 0.05 | 0.05 | 0.05 | 0.05 |
| 5 | | 100 | | | — | 0.10 | 0.05 | 0.05 | 0 |
| 6 | | | 100 | | — | −0.05 | 0.05 | 0 | 0 |
| 7 | 1 | 5 | | | — | −0.10 | −0.10 | −0.10 | −0.10 |
| 8 | 4 | 100 | | | — | −0.10 | −0.10 | −0.05 | 0 |
| 9 | | | | 1 | — | −0.20 | −0.20 | −0.25 | −0.30 |
| 10 | | | | 4 | — | −0.40 | −0.20 | −0.30 | −0.40 |
| 11 | | 5 | | 1 | — | −0.15 | −0.15 | −0.20 | −0.20 |
| 12 | | 100 | | 4 | — | −0.25 | −0.25 | −0.30 | −0.25 |

As can be seen, the viscosity increased in the methyl oleate sample as well as those containing DEHA or hydroquinone only. However, an unexpected synergy can be seen in the samples containing both DEHA and HQ or those containing TEAO and HQ in decreasing the viscosity and maintaining low viscosity over a 28-day period. In those cases where the viscosity actually decreased with time, it is believed that this may be due to solvency effects of the various species in the antioxidant package and/or the oxidation products thereof.

Although the invention is illustrated and described herein with reference to specific embodiments, it is not intended that the subjoined claims be limited to the details shown. Rather, it is expected that various modifications may be made in these details by those skilled in the art, which modifications may still be within the spirit and scope of the claimed subject matter and it is intended that these claims be construed accordingly.

What is claimed:

1. A composition comprising:

a) a fatty ester component constituting at least 50 wt % of the composition and comprising an unsaturated fatty ester; and b) an antioxidant package comprising a phenolic antioxidant or precursor thereof and a nonphenolic oxygen scavenger or precursor thereof;

wherein the nonphenolic oxygen scavenger or precursor thereof comprises a hydroxylamine, an amine N-oxide, an oxime, a nitrone, or a mixture of any of these.

2. The composition of claim 1, wherein the nonphenolic oxygen scavenger or precursor thereof comprises a hydroxylamine.

3. The composition of claim 1, wherein the nonphenolic oxygen scavenger or precursor thereof comprises an amine N-oxide.

4. The composition of claim 1, wherein the nonphenolic oxygen scavenger or precursor thereof comprises a compound having a vapor pressure greater than 10 Torr at 25° C.

5. The composition of claim 1, wherein the nonphenolic oxygen scavenger or precursor thereof constitutes from 0.001 to 5 wt % of the composition.

6. The composition of claim 1, wherein the phenolic antioxidant or precursor thereof comprises hydroquinone.

7. The composition of claim 1, wherein the phenolic antioxidant or precursor thereof comprises a catechol.

8. The composition of claim 1, wherein the fatty ester component comprises a biodiesel.

9. The composition of claim 8, further comprising a petroleum distillate.

10. The composition of claim 1, wherein the nonphenolic oxygen scavenger or precursor thereof comprises diethylhydroxylamine and triethylamine N-oxide, the phenolic antioxidant comprises hydroquinone, and the fatty ester component comprises biodiesel.

11. A composition comprising:

a) a fatty ester component constituting at least 50 wt % of the composition and comprising an unsaturated fatty ester; and b) an amine N-oxide.

12. A method of making a stabilized composition, comprising blending together:

a) a fatty ester component comprising an unsaturated fatty ester; and b) an antioxidant package comprising a phenolic antioxidant or precursor thereof and a nonphenolic oxygen scavenger or precursor thereof;

wherein the nonphenolic oxygen scavenger or precursor thereof comprises a hydroxylamine, an amine N-oxide, an oxime, a nitrone, or a mixture of any of these.

13. The method of claim 12, wherein the nonphenolic oxygen scavenger or precursor thereof comprises a hydroxylamine.

14. The method of claim 12, wherein the nonphenolic oxygen scavenger or precursor thereof comprises an amine N-oxide.

15. The method of claim 12, wherein the nonphenolic oxygen scavenger or precursor thereof comprises a compound having a vapor pressure greater than 10 Torr at 25° C.

16. The method of claim 12, wherein the nonphenolic oxygen scavenger or precursor thereof constitutes from 0.01 to 5 wt % of the composition.

17. The method of claim 12, wherein the phenolic antioxidant or precursor thereof comprises hydroquinone.

18. The method of claim 12, wherein the phenolic antioxidant or precursor thereof comprises a catechol.

19. The method of claim 12, wherein the fatty ester component comprises a biodiesel.

20. The method of claim 19, wherein the composition further comprises a petroleum distillate.

21. The method of claim 12, wherein the nonphenolic oxygen scavenger or precursor thereof comprises diethylhydroxylamine and triethylamine N-oxide, the phenolic antioxidant comprises hydroquinone, and the fatty ester component comprises biodiesel.

22. The method of claim 12, wherein the phenolic antioxidant or precursor thereof comprises p-benzoquinone.

* * * * *